US006495951B1

(12) United States Patent
Kim et al.

(10) Patent No.: US 6,495,951 B1
(45) Date of Patent: Dec. 17, 2002

(54) CATHODE-RAY TUBE WITH ENHANCED YOKE MOUNTING STRUCTURE

(75) Inventors: Ki-Tae Kim, Seoul (KR); Jin-Mok Bak, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/566,815

(22) Filed: May 8, 2000

(30) Foreign Application Priority Data

May 12, 1999 (KR) ..... 99-16890

(51) Int. Cl.[7] ..... H01J 29/70; H01J 31/00

(52) U.S. Cl. ..... 313/440; 313/477; 313/477 R; 335/210; 335/213; 220/2.1 A

(58) Field of Search ..... 313/440, 477, 313/477 R, 472, 473; 220/21 A, 2.1 R, 2.3 A; 335/209–214

(56) References Cited

U.S. PATENT DOCUMENTS 3,731,129 A * 5/1973 Tsuneta et al. ..... 313/403
5,763,995 A * 6/1998 Sano et al. ..... 313/477 R
5,929,559 A * 7/1999 Sano et al. ..... 220/2.1 A
5,962,964 A * 10/1999 Sano et al. ..... 313/440
6,087,767 A * 7/2000 Sano et al. ..... 220/2.1 A
6,268,692 B1 * 7/2001 Yokota et al. ..... 220/2.1 A
6,307,313 B1 * 10/2001 Fukuda ..... 313/421

FOREIGN PATENT DOCUMENTS

JP 2000149826 A * 5/2000 ..... H01J/29/86
JP 2000323070 A * 11/2000 ..... H01J/29/86

* cited by examiner

*Primary Examiner*—Nimeshkumar D. Patel
*Assistant Examiner*—Sikhar Roy
(74) *Attorney, Agent, or Firm*—Fleshner & Kim, LLP

(57) ABSTRACT

The disclosed cathode-ray tube has a panel provided with a fluorescent screen on an inner surface thereof, a funnel joined to the panel, a neck joined to the funnel and provided with electron guns facing the fluorescent screen, and a pyramidal yolk mounting part provided in a region extending from the neck side to the panel side, the pyramidal yolk mounting part having an inside profile in a rectangular form projecting to the outside of the funnel with fixed radii of curvature, the rectangular cross section of the yolk mounting part being designed to have the ratio of a radius of outer curvature to a radius of inner curvature in the range of $0.70 \leqq Rov/Riv \leqq 0.90$ and $0.70 \leqq Roh/Rih \leqq 0.93$, wherein Rov and Riv are radii of outer and inner curvatures on the minor axis perpendicular to the tubular axis, respectively; and Roh and Rih are radii of outer and inner curvatures on the major axis perpendicular to the tubular axis, respectively. Thus the yolk mounting part has the optimized ratio of a radius of outer curvature to a radius of inner curvature to increase atmospheric pressure resistance, secure the margin for ITC rotation and reduce deflection power consumption.

16 Claims, 7 Drawing Sheets

CATHODE-RAY TUBE WITH ENHANCED YOKE MOUNTING STRUCTURE

BACKGROUND OF THE INVENTION

1. Field of the Invention

The present invention relates to a cathode-ray tube for color picture tube, color monitor and the like, and more particularly, to a cathode-ray tube having a yoke mounting part in the form of a pyramid to raise a degree of freedom in rotation during an ITC process and enhanced productivity, with the radii of inner and outer curvatures of the funnel and the thickness being optimized to enhance atmospheric pressure resistance and deflection sensitivity.

2. Background of the Related Art

In general, a color cathode-ray tube, for example, has an outer vacuum tube made of glass that comprises a panel having an approximately rectangular screen, a funnel joined to the panel, and a cylindrical neck joined to the funnel. The neck is internally provided with electron guns emitting three electron beams, and a deflection yoke is provided around the circumference of the funnel to control deflection of the electron beams. A portion of the funnel in which the deflection yoke is mounted is referred to as "yoke mounting part".

The above-structured cathode-ray tube has the electron guns arranged in a line for emitting three electron beams on the same horizontal plane and scans the electron beams over the whole screen in such a manner that the electron beams are deflected with a pincushion-shaped horizontal deflection magnetic field and a barrel-shaped vertical deflection magnetic field generated from the deflection yoke.

Such a general cathode-ray tube has the deflection yoke usually designed based on the funnel. However, in a pyramidal funnel and deflection yoke structure, the cone of the funnel, i.e., the yoke mounting part has to be designed to have an optimal inside profile as determined in consideration of the explosion characteristic and the beam strike neck (BSN) to the beam trajectory, the funnel being designed based on the deflection yoke in the order of deflection yoke profile modeling, beam trajectory calculation, vacuum stress calculation at the funnel bulb, and deflection yoke shape modeling considering deflection sensitivity. This constraint on designing the yoke mounting part requires optimization in designing the outside profile of the funnel so as to enhance atmospheric pressure resistance in consideration of deflection sensitivity and explosion characteristic in a situation that the values related to the inside profile of the funnel are almost fixed.

A color cathode-ray tube is illustrated in FIGS. 1 and 2 as an example of the above-constructed conventional cathode-ray tube.

The color cathode-ray tube has an outer vacuum tube 10 made of glass.

The outer vacuum tube 10 comprises a face panel 3 having an approximately rectangular effective part 1 and a skirt part 2 provided in the periphery of the effective part 1, a funnel 4 joined to the skirt part 2, and a cylindrical neck 7 extending from the funnel 4.

The effective part 1 of the face panel 3 has an approximately rectangular form with horizontal and vertical axes H and V perpendicular to each other through a tubular axis Z of the cathode-ray tube.

And, a deflection yoke 6 is externally provided over an area ranging from the neck 7 to the funnel 4. The funnel 4 has a small-diameter region, so-called yoke mounting part 12 extending from the joint with the neck 7 to the mount position of the deflection yoke 6., i.e., extending to the side of the face panel 3.

On the inner surface of the effective part 1 of the face panel 3 are provided a fluorescent screen S comprising three dot or stripe type fluorescent layers emitting blue, green and red lights, and a stripe type light-shielding layer interposed between the fluorescent layers.

The outer vacuum tube 10 is internally provided with a shadow mask 11 as a dichroic electrode opposite to the fluorescent screen 5.

And, electron guns 9 emitting three electron beams 8 are provided in the neck 7. The three electron beams 8 emitted from the electron guns 9 are deflected by the horizontal and vertical magnetic fields generated from the deflection yoke 6, thus horizontally and vertically scanning the fluorescent screen 5 via the shadow mask 11 to form a color image on the screen 5.

The yoke mounting part 12 of the funnel 4 in which the deflection yoke 6 is mounted in the color cathode-ray tube has an approximately pyramidal form. Here, the deflection yoke 6 is of a saddle shape with less leakage magnetic field and comprises a cylindrical frame made of a synthetic resin for fixing horizontal and vertical deflecting coils and a core. More specially, the pyramidal yoke mounting part 12 has a circular cross section perpendicular to the tubular axis Z as the neck 7 around the joint with the neck 7 and an approximately rectangular cross section in conformity with the profile of the effective part 1 of the face panel 3, as shown in FIGS. 3 and 4, around the central portion along the tubular axis Z and the end portion on the side of the fluorescent screen 5.

As illustrated in FIG. 4, the cross section of the yoke mounting part 12 has the outside profile in an approximately rectangular form constituted by the continuity of a pair of circular arcs 20 for a horizontal radius Roh having a center on the horizontal (major) axis H with respect to the effective part 1, a pair of circular arcs 21 for a vertical radius Rov having a center on the vertical (minor) axis V, and a pair of circular arcs 22 for a diagonal radius Rod having a center on the diagonal axis D.

That is, as shown in FIG. 3, the cross section of the yoke mounting part 12 has the inside profile with inner diameters La, Sa and da in the directions of horizontal (major), vertical (minor) and diagonal axes H, V and D, respectively, extending from the joint with the neck 7 to the end of the deflection yoke 6.

The yoke mounting part has, as also shown in FIG. 3, outer diameters DA, LA and SA in the directions of diagonal, horizontal (major) and vertical (minor) axes D, H and V, respectively, extending from the joint with the neck 7 to the screen side of the deflection yoke 6, i.e., the end of the deflection yoke 6.

As such, the cross section of the yoke mounting part 12 perpendicular to the tubular axis Z has the outside profile almost in the same circular form as the neck 7 around the joint with the neck 7, and in an approximately rectangular form on the side of the fluorescent screen 5 with a gradual decrease in the outer diameters LA and SA in the directions of the major and minor axes, respectively, with respect to the outer diameter DA in the direction of the diagonal axis D.

While on the other, the yoke mounting part 12 has the inside profile not in a perfect plane but in a pincushion form protruding in the direction of the tubular axis Z, as illustrated in FIG. 3. That is, the cross section perpendicular to the tubular axis Z of the yoke mounting part 12 has the inside profile not in a perfect rectangular form but in an imperfect rectangular form of which the sides form a convex curve protruding in the direction of the tubular axis Z.

Each short side 24 for the inside profile of the yoke mounting part 12 is in the form of a convex curve having an apical part on the horizontal axis H, each long side 25 being in the form of a convex curve having an apical part on the vertical axis V.

In a case where the long and short sides 25 and 24 for the inside profile are in the form of a convex curve, the individual corners are all formed with arc curves, i.e., arcs 22 and 26 in both inside and outside profiles so as to prevent an abrupt decrease in the diagonal thicknesses due to a difference between inner and outer diameters La and LA in the direction of the horizontal (major) axis, and a difference between inner and outer diameters Sa and SA in the direction of the minor axis.

The long and short sides perpendicular to the tubular axis Z with respect to the inside profile of the yoke mounting part 12 have thicknesses Th and Tv as determined based on the profile of an electron beam passage region 23 in the yoke mounting part 12, as shown in FIG. 5.

Therefore, as described above, the cross section of the yoke mounting part 12 has an inside profile formed with convex curves in the form of a pincushion approximate to the electron beam passage region 23, thereby converging the inside of the yoke mounting part 12 on the electron beam passage region 23.

The cross section of the yoke mounting part 12 of the funnel 4 has the outside profile in an approximately rectangular form, with the inside profile having the respective sides in the form of a convex curve protruding in the direction of the tubular axis Z. This approximates the inside of the yoke mounting part 12 to the electron beam passage region 23 and enhances deflection efficiency of the deflection yoke 6 to reduce deflection power consumption.

Such a pyramidal yoke mounting part 12 enables reduction of the horizontal and vertical diameters in the directions of the horizontal (major) and vertical (minor) axes H and V of the deflection yoke 6, respectively. Thus the horizontal and vertical deflecting coils of the deflection yoke 6 become closer to the electron beams 8 to efficiently deflect the electron beams 8 and reduce deflection power consumption.

However, in the yoke mounting part 12 having the outside profile in an approximately rectangular form constituted by the continuity of radii of curvatures Roh, Rov and Rod along the major, minor and diagonal axes perpendicular to the tubular axis Z, simply decreasing the diameter of the neck 7 or the outer diameters of the yoke mounting part 12 of the funnel 4 may have the electron beams 8 out of the line collide with the inner wall in the vicinity of the neck 7 of the funnel 4, thus forming a non-fluorescent region 27 on the fluorescent screen 5 at which the electron beams 8 do not arrive, as shown in FIG. 7. And, as the yoke mounting part 12 approximates a rectangular form, deformation occurs in originally flat vicinities 100 and 101 of the horizontal and vertical axes H and V in the directions as indicated by broken lines 103 of FIG. 7 clue to a load F of the atmospheric pressure. The deformation causes compressive stresses σH and σN on the outer surface of the horizontal and vertical vicinities 100 and 101 of the yoke mounting part 12 and an excessive tensile stress σD on the outer surface of a vicinity 102 of the diagonal axis D, as a result of which the outer vacuum tube 10 has a deterioration of the atmospheric pressure resistance and safety.

In an attempt to overcome the problem for wide-angle deflection, for example, a tube has been developed to have a deflection angle of 110 degrees. However; such a wide-angle deflection increases a deflection angle of the corners to cause neck shadow, i.e., beam strike neck (BSN) on the corners of the inner surface of the funnel and deteriorate atmospheric pressure resistance.

In the aspect of this problem,Japanese Patent Sho8-225545 andjapanese Patent Pyung 10-154472 disclose a yoke mounting part of the funnel 4 in the conical form that reduces the distance from the deflection yoke to the electron beams in order to prevent formation of the non-fluorescent region and deterioration of atmospheric pressure resistance.

According to Japanese Patent Sho58-225545, the inner surface of the conical funnel has appropriate grooves at the corners to prevent collision of electron beams with the inner surface of the funnel arid thereby enhance deflection sensitivity. Also, Japanese Patent Pyung10-154472 describes a yoke mounting part whose cross section has inside and outside profiles with two horizontal sides opposite to each other based on the horizontal axis interposed between them in the form of a straight line and two vertical sides opposite to each other based on the vertical axis between them in the form of a convex curve protruding in the direction of the tubular axis, thus enhancing atmospheric pressure resistance with a thickness difference between the long or short sides and the corners.

However, with an excessive difference in the thickness between the long or short sides and the corners in order to secure the margin of BSN, the conical cathode-ray tube according to Japanese Patent Sho58-225545 may have an increase in the maximum vacuum strength (tensile strength) on the corners of the funnel to cause explosion of an exhaust gas in the manufacture of the cathode-ray tube and increment the distance from the deflecting coils to the electron beam passage region,thus increasing deflection power consumption. Otherwise, when the thickness difference between the long or short sides and the corners is decreased in order to prevent explosion and reduce deflection power consumption, an excessive stress occurs on the BSN and the long and short sides.

According to Japanese Patent Pyung10-154472, the yoke mounting part has an inside profile in the form of an inwardly projecting pincushion to increase a thickness representing a difference between inner and outer diameters, which increases the weight of the funnel.

Especially, the wide-angle deflecting pyramidal cathode-ray tube has a difficulty in securing neck shadow and the margin for rotation of the deflection yoke in an ITC process (a step of controlling the deflection yoke to optimize the screen during installation of the deflection yoke after manufacture of a tube), thus resulting in deterioration of productivity.

SUMMARY OF THE INVENTION

It is, therefore, an object of the present invention to provide a cathode-ray tube that optimizes inner and outer curvatures and thicknesses of a deflection yoke mounting part of a funnel to secure the margin for ITC rotation and atmospheric pressure resistance and maximize deflection sensitivity, in which when divided into equal "n" parts, the yoke mounting part in the form of a pyramid has the inner and outer curvatures differentiated at the individual positions to minimize the thickness of the funnel.

In accordance with an aspect of the present invention to achieve the above object, there is provided a cathode-ray tube which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side. When the yoke mounting part has inside and outside profiles in an approximately rectangular form and the profiles include a position where the cross section of the yoke mounting part perpendicular to a tubular axis is maximized, other than major and minor axes, a curvature ratio on an inflection point with respect to the tubular axis is in the range of $0.85 \leqq Rov/Riv \leqq 0.90$ and $0.89 \leqq Roh/Rih \leqq 0.93$, wherein Rov and Riv are radii of outer and inner curvatures on the minor axis perpendicular to the tubular axis, respectively; and Roh and Rih are radii of outer and inner curvatures on the major axis perpendicular to the tubular axis, respectively.

Preferably, in the cross section of the yoke mounting part, the ratio of a radius of outer curvature to a radius of inner curvature on the minor axis perpendicular to the tubular axis is in the range from 0.70 to 0.90, and the ratio of a radius of outer curvature to a radius of inner curvature on the major axis is in the range from 0.70 to 093. If the ratio of a radius of outer curvature to a radius to inner curvature on the major or minor axis of the yoke mounting part is less than 0.70, the diagonal thickness of the funnel becomes larger to increase deflection power consumption, thereby deteriorating deflection sensitivity and causing neck shadow and a difficulty in the ITC process. If the ratio exceeds 0.90 or 0.93, the diagonal thickness of the funnel becomes smaller to deteriorate tensile strength. It is therefore desirable that the curvature ratio satisfies the above relation, in order to secure sufficient atmospheric pressure resistance, deflection sensitivity and the margin for ITC rotation.

In accordance with another aspect of the present invention, there is provided a cathode-ray tube which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side; and when the yoke mounting part has inside and outside profiles in an approximately rectangular form and the profiles include a position where the cross section of the yoke mounting part perpendicular to a tubular axis is maximized, other than major and minor axes, the ratio of a radius of outer curvature to a radius of inner curvature for long sides on the major axis perpendicular to the tubular axis being in the range from 0.70 to 0.93, the ratio of a radius of outer curvature to a radius of inner curvature for short sides on the minor axis being in the range from 0.70 to 0.90.

Optionally, when the yoke mounting part is equally divided into the vicinity of a joint with the neck and a deflection base point, (1) a curvature ratio in the vicinity of the joint with the neck is in the range of $0.70 \leqq Rov/Riv \leqq 0.75$ and $0.70 \leqq Roh/Rih \leqq 0.75$; and (2) a curvature ratio on the deflection base point is in the range of $0.75 \leqq Rov/Riv \leqq 0.81$ and $0.75 \leqq Rob/Rih \leqq 0.77$, wherein Rov and Riv are radii of outer and inner curvatures for the short sides perpendicular to the tubular axis of the yoke mounting part, respectively; and Roh and Rih are radii of outer and inner curvatures for the long sides perpendicular to the tubular axis, respectively.

Optionally, a curvature ratio on an inflection point with respect to the tubular axis is in the range of $0.85 \leqq Rov/Riv \leqq 0.90$ and $0.89 \leqq Roh/Rih \leqq 0.93$.

As such, the yoke mounting part has the ratio of a radius of outer curvature to a radius of inner curvature differentiated in the vicinity of the joint with the neck, on the inflection point and on the deflection baseline to minimize the thickness of the funnel, especially diagonal thickness, thus minimizing atmospheric pressure stress imposed on the funnel and enhancing the margin for ITC rotation and deflection sensitivity.

Thus the atmospheric pressure resistance of the wide-angle deflecting outer vacuum tube can be secured to effectively reduce deflection power consumption and thereby realize high brightness an high frequency deflection.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Hereinafter, preferred embodiments of a cathode-ray tube according to the present invention will be described in detail with reference to the attached drawings.

Figure 1:
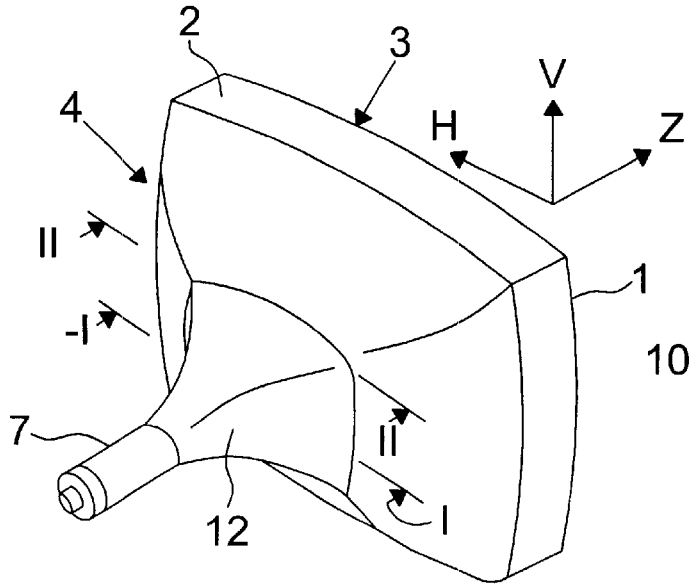
PRIOR ART FIG. 1
FIG. 1 is a rear view of a cathode-ray tube for explaining a prior art.
Figure 2:
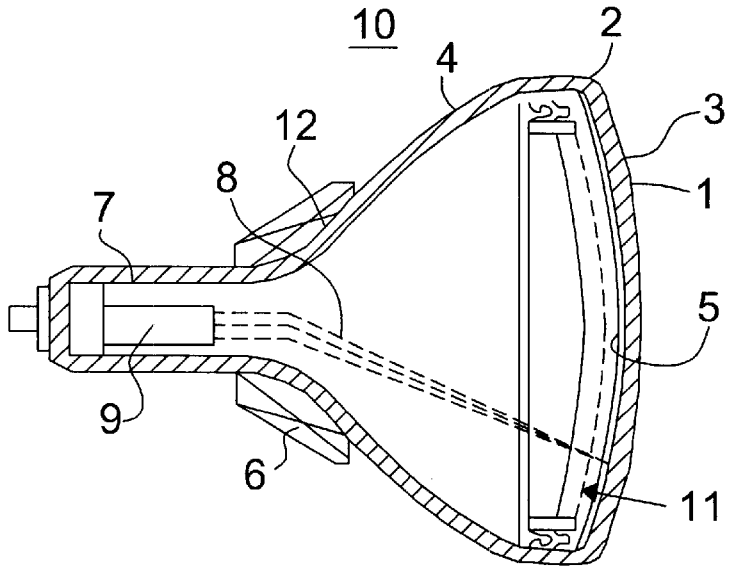
PRIOR ART FIG. 2
FIG. 2 is a cross-sectional view taken along the tubular axis of FIG. 1.
Figure 3:
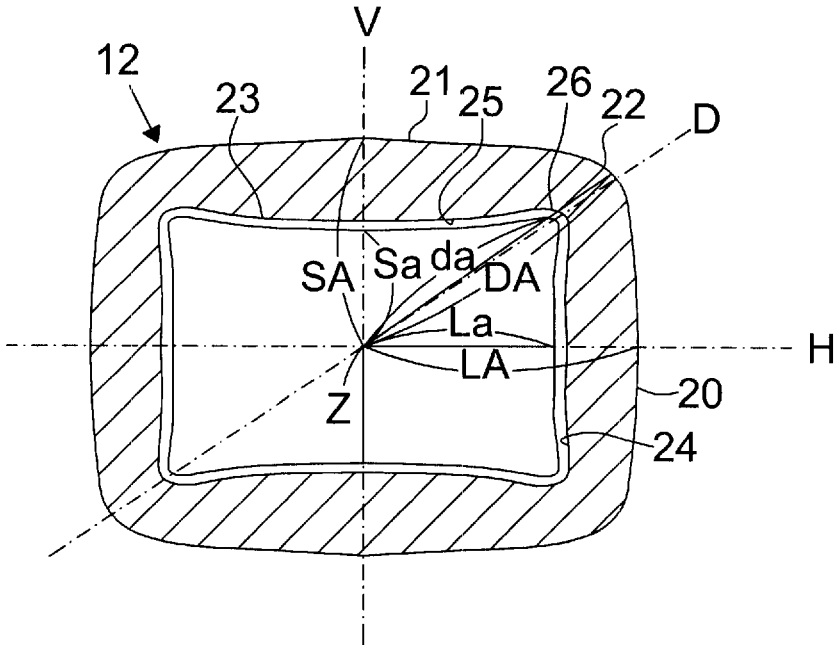
PRIOR ART FIG. 3
FIG. 3 is a cross-sectional view taken along the line I—I of FIG. 1 according to the prior art.
Figure 4:
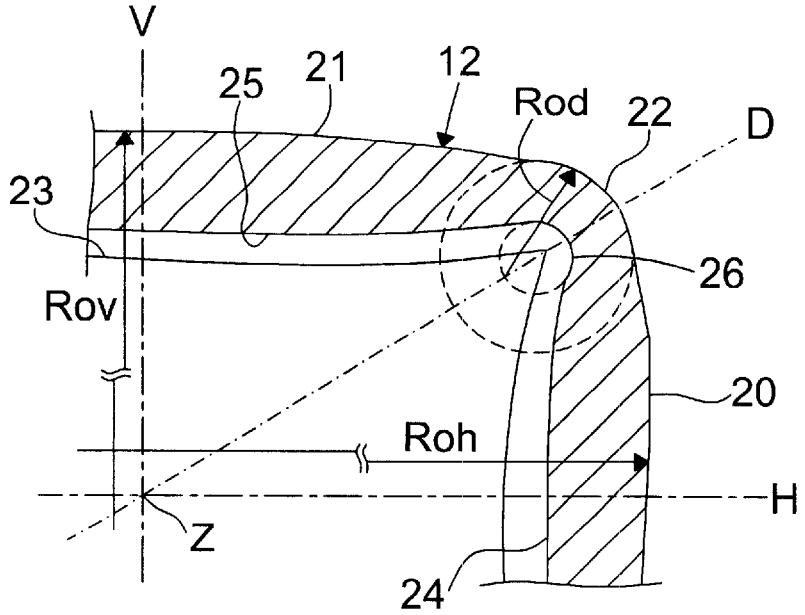
PRIOR ART FIG. 4
FIG. 4 is a cross-sectional view taken along the line II—II of FIG. 1 according to the prior art.
Figure 5:
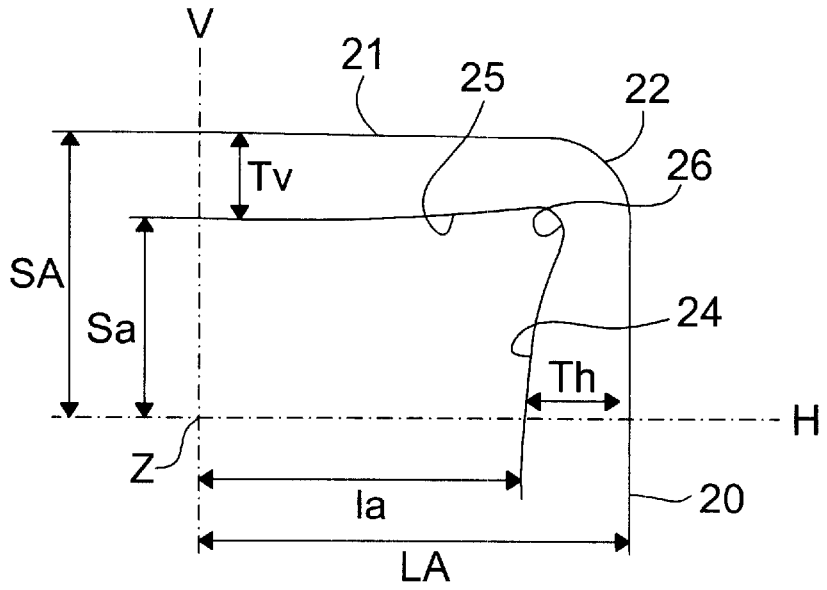
PRIOR ART FIG. 5
FIG. 5 is a detailed partial view for explaining inside and outside profiles of the yoke mounting part of FIG. 1.
Figure 6:
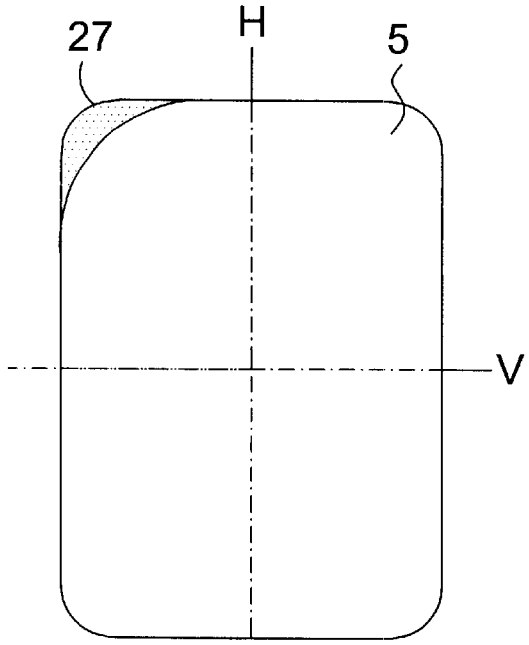
PRIOR ART FIG. 6
FIG. 6 is a front view of the cathode-ray tube for explaining the drawbacks of the prior art.
Figure 7:
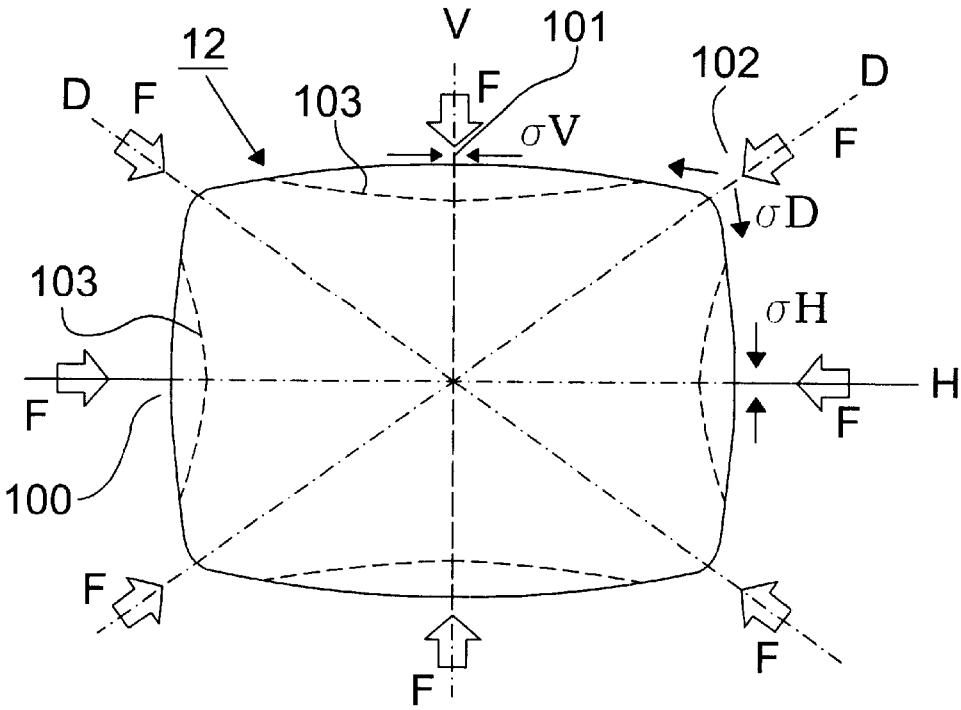
PRIOR ART FIG. 7
FIG. 7 is a diagram for explaining stresses occurring on the yoke mounting part of FIG. 1.
Figure 8:
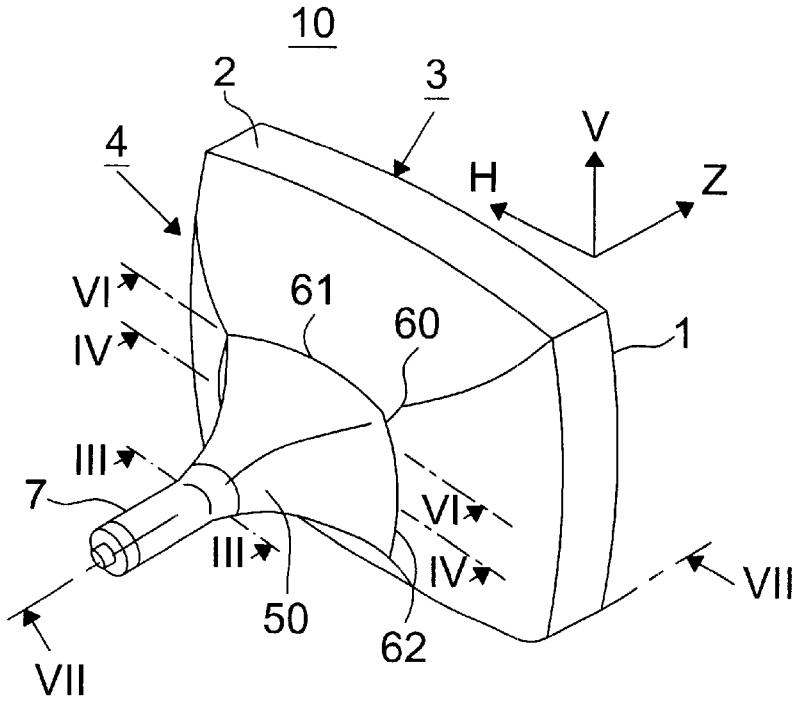
FIG. 8 is a perspective view of a cathode-ray tube for explaining the present invention.
Figure 9:
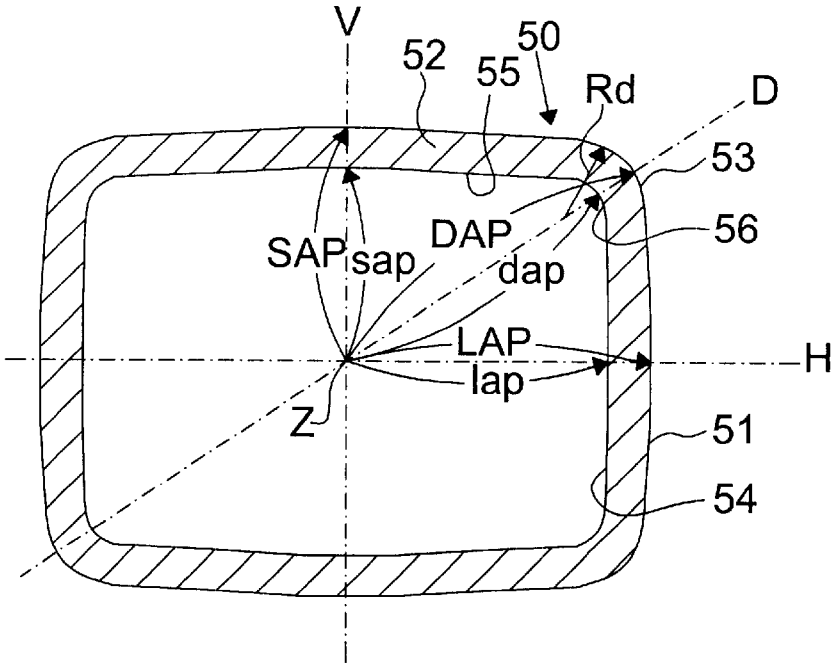
FIG. 9 is a cross-sectional view of the pyramidal yoke mounting part of FIG. 8 in accordance with the present invention.

FIG. 8 is a perspective view of a cathode-ray tube for explaining the present invention, FIG. 9 is a cross-sectional view of a pyramidal yoke mounting part of FIG. 8, and FIGS. 10 to 12 are cross-sectional views taken along the lines III—III, IV—IV and VI—VI of FIG. 8, respectively.

The color cathode-ray tube of the present invention has an outer vacuum tube 10 made of glass.

The outer vacuum tube 10 comprises a face panel 3 having an approximately rectangular effective part 1 and a skirt part 2 provided in the periphery of the effective part 1, a funnel 4 joined to the skirt part 2, and a cylindrical neck 7 extending from the funnel 4.

The effective part 1 of the face panel 3 has an approximately rectangular form with horizontal and vertical axes H and V perpendicular to each other through a tubular axis Z of the cathode-ray tube.

The funnel 4 has a small-diameter region; so-called yoke mounting part 50 extending from the joint with the neck 7 to the mount position of a deflection yoke 6, i.e., extending to the side of the face panel 3.

Especially, the yoke mounting part 50 of the funnel 4 in which the deflection yoke 6 is mounted in the color cathode-ray tube has an approximately pyramidal shape.

More specially, the pyramidal yoke mounting part 50 has a circular cross section perpendicular to the tubular axis Z around the joint with the neck 7 and an approximately rectangular cross section in conformity with the profile of the effective part 1 of the face panel 3, as shown in FIGS. 9 to 12, around the central portion along the tubular axis Z and the end portion on the side of a fluorescent screen 5. That is, the circular form changes into the rectangular form from the joint with the neck 7 to the end of the screen 5 along the tubular axis.

The cross section of the yoke mounting part 12 has, as illustrated in FIG. 9, an outside profile in an approximately rectangular form constituted by the continuity of a pair of circular arcs 51 for a horizontal radius of curvature Roh having a center on the horizontal axis H, a pair of circular arcs 52 for a vertical radius of curvature Rov having a center on the vertical axis V, and a pair of circular arcs 53 for a diagonal radius of curvature Rod having a center on the diagonal axis D.

Figure 13:
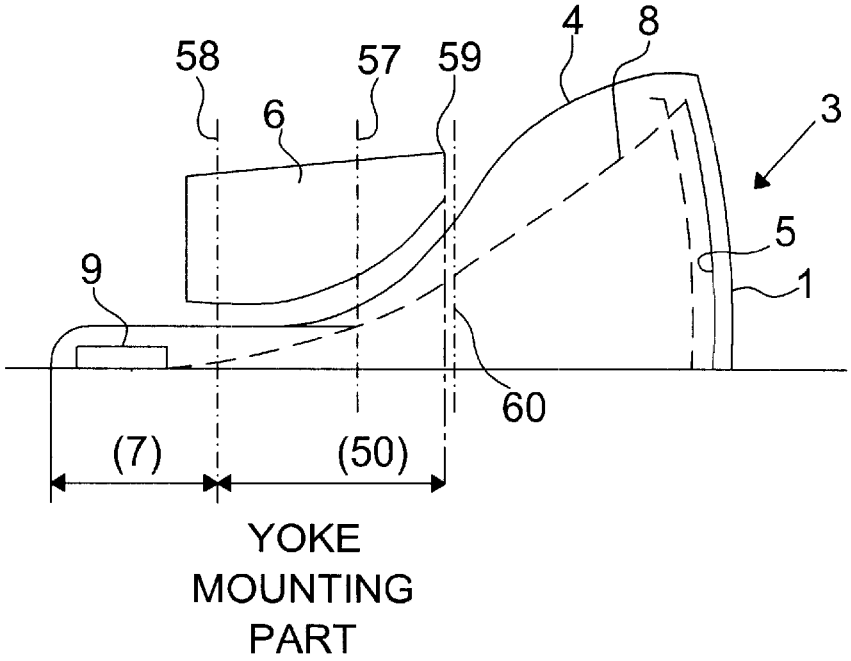
FIG. 13 is a cross-sectional view taken along the line VII—VII of FIG. 8 in accordance with the present invention.

As illustrated in FIG. 13, the deflection yoke 6 is mounted to have an end 59 on the side of the panel 3 be located in the vicinity of a diagonal inflection point 60 arid the pyramidal yoke mounting part 50 substantially extends at least to a joint 58 with the neck 7.

The inside and outside profiles of the yoke mounting part 50 are shown in FIGS. 8 and 9.

The cross section of the yoke mounting part 50 has, as shown in. FIGS. 8 and 9, an inside profile in which a long side inflection point 61, a short side inflection point 62 and the diagonal inflection point 60 have the same position on the horizontal, vertical and diagonal axes H, V and D with respect to the coordinates in the direction of the tubular axis Z. Thus the inside profile has inner diameters lap, sap and dap in the directions of the horizontal (major), vertical (minor) and diagonal axes H, V and D, respectively, extending from the joint 58 with the neck 7 to the end 59 of the deflection yoke 6.

The outside profile of the yoke mounting part 50 has an outer diameter DAP in the direction of the diagonal axis D, an outer diameter LAP in the direction of the horizontal (major) axis H larger than lap, and an outer diameter SAP in the direction of the vertical (minor) axis V larger than sap, extending from the joint 58 with the neck 7 to the end 59 of the deflection yoke 6.

Figure 14:
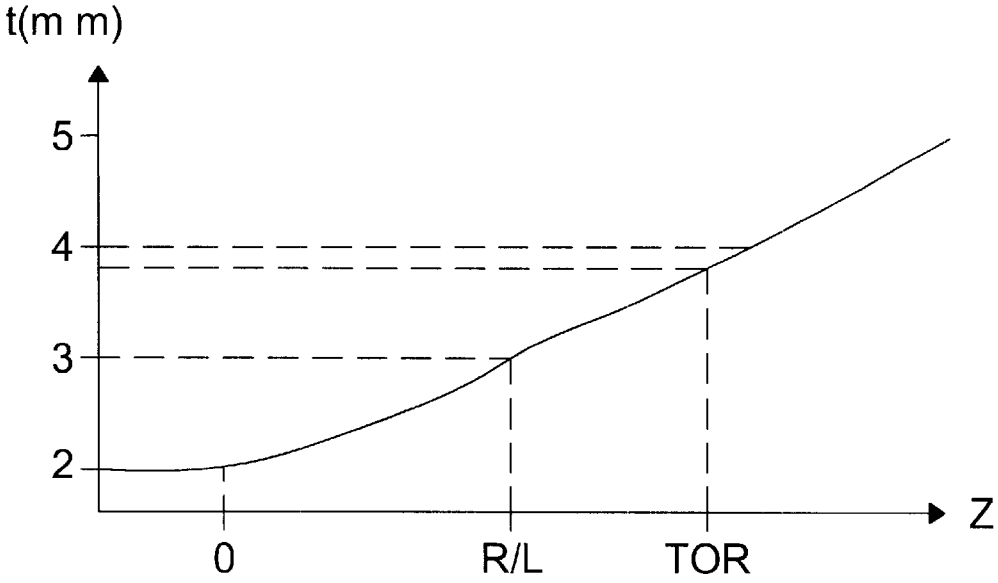
FIG. 14 is a diagram for explaining thickness distribution of a pyramidal funnel in the cathode-ray tube of the present invention.

As illustrated in FIGS. 13 and 14, the yoke mounting part 50 has a thickness Th representing a difference between inner and outer diameters lap and LAP in the direction of the horizontal (major) axis H, and a thickness Tv representing a difference between inner and outer diameters sap and SAP in the direction of the vertical (minor) axis V, in the cross section taken along the tubular axis Z approximately corresponding to the deflection center, referred to as a deflection baseline R/L 57.

The maximum vacuum stress, which refers to the maximum stress imposed on the entire region of the yoke mounting part 50, occurs in the tensile direction at the respective corners of the pyramidal yoke mounting part 50 slightly towards the side of the fluorescent screen 5 rather than the deflection baseline 57.

As such, the yoke mounting part 50 has the inside profile not in a perfect plane but in an approximately rectangular form slightly protruding in the direction of the funnel 4, i.e., towards the outside of the yoke mounting part 50. The inside profile has long sides with a thickness representing a difference between inner and outer diameters lap and LAP, and short sides with a thickness representing a difference between inner and outer diameters sap and SAP. In other words, the cross section perpendicular to the tubular axis Z of the yoke mounting part 50 has the inside profile not in a perfect rectangular form but in an imperfect rectangular form of which the respective sides are formed of a convex curve gently protruding along the sealing side of the neck 7 with inner diameters lap and sap along the major and minor axes, respectively.

Figure 10:
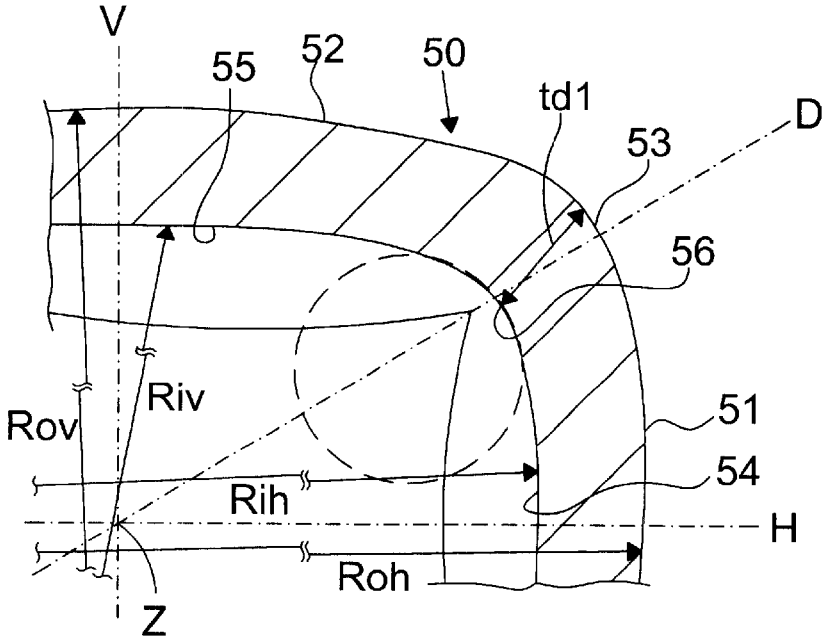
FIG. 10 is a cross-sectional view taken along the line III—III of FIG. 8 in accordance with the present invention.
Figure 11:
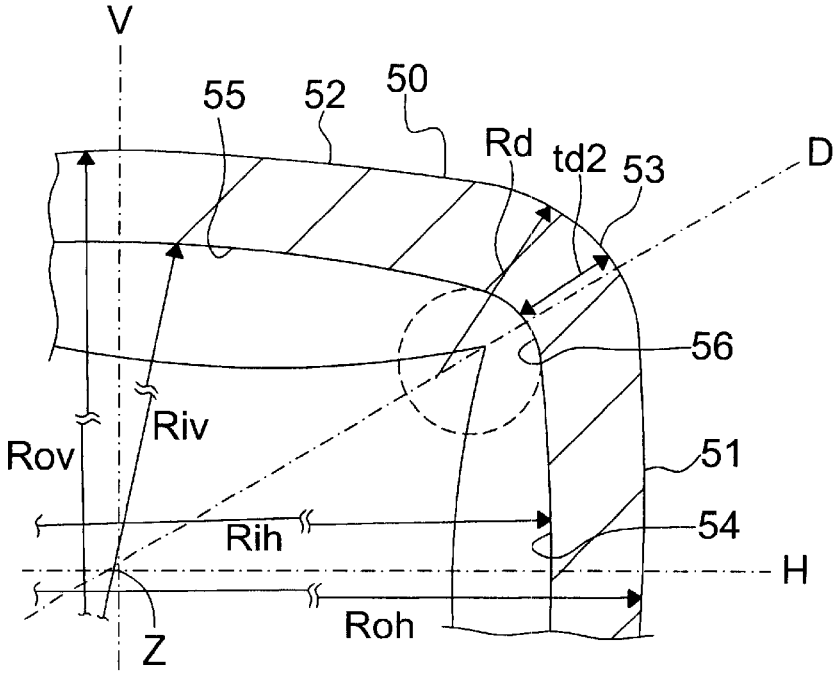
FIG. 11 is a cross-sectional view taken along the line IV—IV of FIG. 8 in accordance with the present invention.
Figure 12:
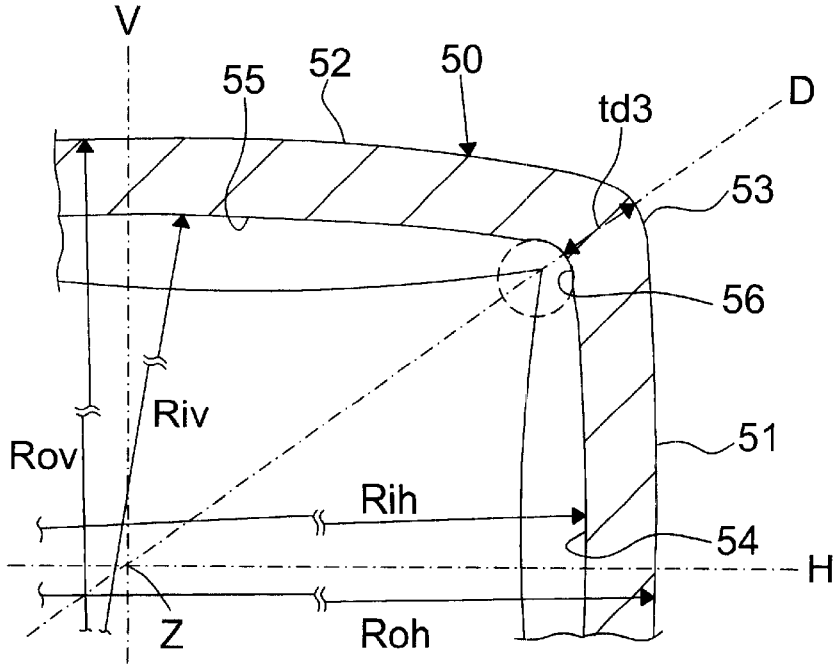
FIG. 12 is a cross-sectional view taken along the line VI—VI of FIG. 8 in accordance with the present invention.

Short sides 54 of the inside profile of the yoke mounting part 50 axe formed with a pair of circular arcs having a center on the horizontal axis H, long sides 55 being formed with a pair of circular arcs having a center on the vertical axis V, as shown in FIGS. 10 to 12.

In a case where the long and short sides 55 and 54 of the inside profile are formed with gentle curves, the individual corners are all formed with arc curves 53 and 56 in both inside and outside profiles due to an increase in a horizontal thickness representing a difference between inner and outer diameters lap and LAP along the horizontal axis H and a vertical thickness representing a difference between inner and outer diameters sap and SAP along the vertical axis V. Thus the inside profile of the yoke mounting part 50 approaches the electron beam passage region to secure a sufficient internal space.

Especially, in a case of a color cathode-ray tube having the pyramidal yoke mounting part 50 for wide-angle deflection (e.g., at a diagonal deflection angle of more than 95 degrees), the inside profile of deflecting coils have to be designed according to the deflection angle in adjusting the deflection yoke 6 to approach the electron beams to the magnetic fields generated from the deflecting coils and thereby reduce deflection power consumption, thus enhancing deflection sensitivity. Therefore, it is required to differentiate the radii of inner and outer curvatures of the yoke mounting part 50 in the vicinity of the joint 58 with the neck 7, on a deflection baseline 57 and at inflection points, particularly, diagonal inflection points, in order to optimize the diagonal thicknesses, thus securing sufficient atmospheric pressure resistance of the outer vacuum tube and the margin for ITC rotation.

According to the present invention, the cross section of the yoke mounting part 50 has inside and outside profiles in an approximately rectangular form (barrel form) in the neck sealing direction with respect to the tubular axis Z along the horizontal (major) and vertical (minor) axes. With the rectangular yoke mounting part 50 divided along the tubular axis Z into equal "n" parts, i.e., the vicinity of the joint 58 with the neck 7, the deflection baseline R/L 57 and the inflection point TOR 60, as shown in FIGS. 10 to 12, the ratio of a radius of inner curvature to a radius of outer curvature on the horizontal axis H perpendicular to the tubular axis Z is differentiated from the ratio of a radius of inner curvature to a radius of outer curvature on the vertical axis V perpendicular to the tubular axis Z, thus providing sufficient tensile strength of the funnel 4, reducing deflection power consumption and securing the margin for ITC rotation.

In accordance with an example of experiments performed by the inventor of the present invention, the rectangular yoke mounting part 50 is divided along the tubular axis Z into the vicinity of the joint 58 with the neck 7, the deflection baseline R/L 57 and the inflection point TOR 60, as shown in FIGS. 10 to 12. A diagonal thickness td1 of the corners in the vicinity of the joint 58 with the neck 7 can be optimized as shown in FIG. 10, when the ratio of a radius of outer curvature to a radius of inner curvature for the short sides satisfies $0.70 \leqq Rov/Riv \leqq 0.75$; and the ratio of a radius of outer curvature to a radius of inner curvature for the long sides satisfies $0.70 \leqq Roh/Rih \leqq 075$, wherein Riv and Rov are radii of inner and outer curvatures for the short sides perpendicular to the tubular axis Z, respectively; and Rih and Roh are radii of inner and outer curvatures for the long sides perpendicular to the tubular axis Z, respectively, thus forming the corners with the curvatures of the long and short sides.

A diagonal thickness td2 of the corners on the deflection baseline 57 can also be optimized as shown in FIG. 11, when the ratio of a radius of outer curvature to a radius of inner curvature for the short sides perpendicular to the tubular axis Z satisfies $0.75 \leqq Rov/Riv \leqq 0.81$; and the ratio of a radius of outer curvature to a radius of inner curvature for the long sides perpendicular to the tubular axis Z satisfies $0.75 \leqq Roh/Rih \leqq 0.77$.

A diagonal thickness td3 of the corners on the inflection point 60 can also be optimized as shown in FIG. 12, when the ratio of a radius of outer curvature to a radius of inner curvature for the short sides perpendicular to the tubular axis Z satisfies $0.85 \leqq Rov/Riv \leqq 0.90$; and the ratio of a radius of outer curvature to a radius of inner curvature for the long sides perpendicular to the tubular axis Z satisfies $0.89 \leqq Roh/Rih \leqq 0.93$.

Here, the diagonal thicknesses td1, td2 and td3 become larger as the radii of outer curvature for the long and short sides decrease with respect to the radii of inner curvature for the long and short sides.

As a result, the diagonal thicknesses td1, td2 and td3 become smaller depending on the radii of inner and outer curvatures for the long and short sides perpendicular to the tubular axis Z increasingly from the vicinity of the joint 58 of the neck 7 to the inflection point, as shown in FIG. 14, so that the cross section of the yoke mounting part 50 changes from an approximately circular form around the joint 58 of the neck 7 into a rectangular form on the deflection baseline 57 and the inflection point 60, thus providing appropriate tensile strength of the funnel 4, reducing deflection power consumption and securing the margin for ITC rotation.

In accordance with another example of experiments in the present invention, the pyramidal yoke mounting part 50 has the whole cross section of which the corners are formed with curvatures of crossing short and long sides while the ratio of a radius of outer curvature Rov to a radius of inner curvature Riv for the short sides perpendicular to the tubular axis Z satisfies $0.70 \leqq Rov/Riv \leqq 0.90$; and the ratio of a radius of outer curvature Roh to a radius of inner curvature Rih for the long sides perpendicular to the tubular axis Z satisfies $0.70 \leqq Roh/Rih \leqq 0.93$, thus providing appropriate tensile strength of the funnel 4, reducing deflection power consumption and securing the margin for ITC.

The outside of the funnel 4 has to be designed to approach the deflecting coils of the deflection yoke 6. Therefore, when the ratio of a radius of outer curvature to a radius of inner curvature exceeds 0.93 for the yoke mounting part 50 with a fixed thickness of the vertical (minor) axis perpendicular to the tubular axis Z, the diagonal thickness of the funnel 4 is decreased to reduce diagonal deflection power consumption, enhance the deflection sensitivity and the margin for ITC rotation, and decrease tensile strength. If the ratio is less than 0.70, the diagonal thickness of the funnel 4 is excessively increased to raise tensile strength, which increases deflection power consumption and deteriorates deflection sensitivity and the margin for ITC rotation.

The most appropriate tensile strength can be secured with reduced deflection power consumption when the ratio of a radius of outer curvature to a radius of inner curvature for the long sides of the yoke mounting part 50 is in the range from 0.70 to 0.93; and the ratio of a radius of outer curvature to a radius of inner curvature for the short sides is in the range from 0.70 to 0.90, thereby enhancing deflection sensitivity and ITC margin and securing high productivity.

Therefore, in designing the yoke mounting part 50 of the present invention, the diagonal thickness at the greatest deflection angle can be optimized by incrementing the ratio of a radius of outer curvature to a radius of inner curvature increasingly from the vicinity of the joint with the neck 7 to the inflection point, thus preventing occurrence of neck shadow and enhancing deflection sensitivity, atmospheric pressure resistance and the margin for ITC rotation.

In contrast to the prior art where a portion of the corners of the yoke mounting part on the side of the funnel is sectioned to prevent collision with electron beams and the ratio of the diagonal thickness on the corners to the horizontal or vertical thickness on the long or short sides is increased to prevent explosion and reduce deflection power consumption, the present invention designs the pyramidal yoke mounting part to have a cross section with different diagonal thicknesses in the vicinity of the joint with the neck, on the inflection point and on the deflection baseline through inner and outer curvatures of long and short sides, thus minimizing atmospheric pressure stress imposed on the corners of the yoke mounting part as well as securing the margin for ITC rotation and reducing a distance from the electron beams to the magnetic fields of the deflection yoke.

As described above, the present invention provides a pyramidal yoke mounting part nearly approximating the trajectory of electron beams due to a minimized diagonal thickness, and a wide-angle deflecting outer vacuum tube with sufficient internal space, thus securing atmospheric pressure resistance and the margin for ITC rotation and reducing deflection power consumption.

Therefore, the wide-angle deflection cathode-ray tube of the present invention has the yoke mounting part in the form of a pyramid with minimized range of inside and outside curvatures to reduce the diagonal thickness of the largest deflection angle. Thus the atmospheric pressure resistance of the funnel according to the wide-angle deflection can be increased without deterioration of deflection sensitivity, and the margin for ITC rotation can be secured with effective reduction of deflection power consumption.

The pyramidal profile of the yoke mounting part also enhances a degree of freedom for rotation in the ITC process to reduce the weight of the funnel as well as secure productivity.

What is claimed is:

1. A cathode-ray rube, comprising:

a panel provided with a fluorescent screen on an inner surface thereof;

a funnel joined to the panel;

a neck provided with electron guns facing the fluorescent screen; and a pyramidal yoke mounting part formed between the neck and the funnel, wherein a cross-section of the yoke mounting part taken perpendicular to a tubular axis of the cathode ray tube has inside and outside profiles with approximately rectangular forms, wherein short sides and long sides of the inside and outside profiles are convex curves, wherein a curvature ratio of a radius of curvature of the outside profile Rov to a radius of curvature of the inside profile Riv of the long sides at an inflection point is in the range of approximately 0.85≦Rov/Riv≦approximately 0.90 and wherein a curvature ratio of a radius of curvature of the outside profile Roh to a radius of curvature of the inside profile Rih of the short sides at the inflection point is in the range of approximately 0.89≦Roh/Rih≦approximately 0.93.

2. The cathode ray tube as claimed in claim 1, wherein a curvature ratio of a radius of curvature of the outside profile Rov to a radius of curvature of the inside profile Riv of the long sides in the vicinity of a joint with the neck is in the range of approximately 0.70≦Rov/Riv≦approximately 0.75, wherein a curvature ratio of a radius of curvature of the outside profile Roh to a radius of curvature of the inside profile Rih of the short sides in the vicinity of the joint with the neck is in the range of approximately 0.70≦Roh/Rih≦approximately 0.75, wherein a curvature ratio of a radius of curvature of the outside profile Rov to a radius of curvature of the inside profile Riv of the long sides at a deflection base point on the tubular axis is in the range of approximately 0.75≦Rov/Riv≦approximately 0.81, and wherein a curvature ratio of a radius of curvature of the outside profile Roh to a radius of curvature of the inside profile Rih of the short sides at the deflection base point is in the range of approximately 0.75≦Roh/Rih≦approximately 0.77.

3. The cathode ray tube of claim 1, wherein along the entire yoke mounting par, a ratio of a radius of outer curvature to a radius of inner curvature of the long side on the minor axis perpendicular to the tubular axis is in the range from approximately 0.70 to approximately 0.90, and wherein a ratio of a radius of outer curvature to a radius of inner curvature of the short side on the major axis is in the range from approximately 0.70 to approximately 0.93.

4. A cathode-ray tube, comprising:

a panel provided with a fluorescent screen on an inner surface thereof;

a funnel joined to the panel;

a neck provided with electron guns facing the fluorescent screen; and a pyramidal yoke mounting part formed between the neck and the funnel, wherein a cross-section of the yoke mounting part has inside and outside profiles in an approximately rectangular form, wherein a ratio of a radius of outer curvature Roh to a radius of inner curvature Rih for short sides on the major axis perpendicular to the tubular axis is in the range from approximately 0.70 to approximately 0.93, and wherein a ratio of a radius of outer curvature Rov to a radius of inner curvature Riv for long sides on the minor axis is in the range from approximately 0.70 to approximately 0.90.

5. The cathode-ray tube as claimed in claim 4, wherein a ratio of a radius of outer curvature to a radius of inner curvature for the long and short sides perpendicular to the tubular axis in the vicinity of the joint with the neck is in the range from approximately 0.70 to approximately 0.75, and wherein a ratio of a radius of outer curvature to a radius of inner curvature at a deflection base point is in the range of approximately 0.75 to approximately 0.81 for the long sides and in the range of approximately 0.75 to approximately 0.77 for the short sides.

6. The cathode ray tube as claimed in claim 5, wherein a curvature ratio of a radius of outer curvature Rov to a radius of inner curvature Riv for long sides at an inflection point is in the range of approximately 0.85≦Rov/Riv≦approximately 0.90, and wherein a radius of outer curvature Roh to a radius of inner curvature Rih for short sides at the inflection point is approximately 0.89≦Roh/Rih≦approximately 0.93.

7. A cathode-ray tube, comprising:

a panel provided with a fluorescent screen on an inner surface thereof;

a funnel joined to the panel;

a neck portion provided with electron guns facing the fluorescent screen; and a yoke mounting part joining the funnel and the neck portion, wherein a cross-section of the yoke mounting part taken perpendicular to a tubular axis of the cathode ray tube has inner and outer profiles that ate substantially rectangular, the inner and outer profiles being convex curves, wherein a curvature ratio Rov/Riv of a radius of curvature Rov of the outer profile of long sides of the rectangular cross-section to a radius of curvature Riv of the inner profile of the long sides of the cross-section in the vicinity of where the neck joins the yoke mounting part is the range of approximately 0.70 to approximately 0.75.

8. The cathode ray tube of claim 7, wherein a curvature ratio Roh/Rih of a radius of curvature Roh of the outer profile of short sides of the rectangular cross-section to a radius of curvature Rih of the inner profile of the short sides of the rectangular cross-section in the vicinity of where the neck joins the yoke mounting part is in the range of approximately 0.70 to approximately 0.75.

9. The cathode-ray tube of claim 7, wherein a curvature ratio Rov/Riv of a radius of curvature Rov of the outer profile of long sides of the rectangular cross-section to a radius of curvature Riv of the inner profile of the long sides of the cross-section in the vicinity of an inflection point with respect to the tubular axis is the range of approximately 0.85 to approximately 0.90.

10. The cathode ray tube of claim 9, wherein a curvature ratio Roh/Rih of a radius of curvature Roh of the outer profile of short sides of the rectangular cross-section to a radius of curvature Rih of the inner profile of the short sides of the rectangular cross-section in the vicinity of an inflection point with respect to the tubular axis is in the range of approximately 0.89 to approximately 0.93.

11. The cathode ray tube of claim 7, wherein a curvature ratio Rov/Riv of a radius of curvature Rov of the outer profile of long sides of the rectangular cross-section to a radius of curvature Riv of the inner profile of the long sides of the cross-section in the. vicinity of a deflection base point is the range of approximately 0.75 to approximately 0.81.

12. The cathode ray tube of claim 7, wherein a curvature ratio Rov/Riv of a radius of curvature Rov of the outer profile of short side of the rectangular cross-section to a radius of curvature Riv of the inner profile along the long sides of the cross-section in the in the vicinity of a deflection base point is the range of approximately 0.75 to approximately 0.77.

13. A cathode-ray tube, comprising:

a panel provided with a fluorescent screen on an inner surface thereof;

a funnel joined to the panel;

a neck portion provided with electron guns facing the fluorescent screen; and a yoke mounting part joining the funnel and the neck portion, wherein a cross-section of the yoke mounting part taken perpendicular to a tubular axis of the cathode ray tube has inner and outer profiles that are substantially rectangular, the inner and outer profiles being convex curves, wherein a curvature ratio Rov/Riv of a radius of curvature Rov of the outer profile of long sides of the recur cross-section to a radius of curvature Riv of the inner profile of the long sides of the cross-section in the vicinity of a deflection base point is the range of approximately 0.75 to approximately 0.81.

14. The cathode ray tube of claim 13, wherein a curvature ratio Roh/Rih of a radius of curvature Roh of the outer profile of short sides of the rectangular cross-section to a radius of curvature Rih of the inner profile of the short sides of the rectangular cross-section in the vicinity of a deflection base point is in the range of approximately 0.75 to approximately 0.77.

15. The cathode-ray tube of claim 13, wherein a curvature ratio Rov/Riv of a radius of curvature Rov of the outer profile of long sides of the rectangular cross-section to a radius of curvature Riv of the inner profile of the long sides of the cross-section in the vicinity of an inflection point with respect to the tubular axis the range of approximately 0.85 to approximately 0.90.

16. The cathode-ray tube of claim 13, wherein a curvature ratio Rov/Rih of a radius of curvature Rov of the outer profile along long sides of the rectangular cross-section to a radius of curvature Riv of the inner profile along the long sides of the cross-section in the vicinity of an inflection point with respect to the tubular axis is the range of approximately 0.89 to approximately 0.93.

* * * * *